US010406821B2

(12) United States Patent
Mori et al.

(10) Patent No.: US 10,406,821 B2
(45) Date of Patent: Sep. 10, 2019

(54) LIQUID DISCHARGE HEAD USING DISCHARGE ENERGY GENERATION ELEMENTS

(71) Applicant: CANON KABUSHIKI KAISHA, Tokyo (JP)

(72) Inventors: Tatsurou Mori, Yokohama (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/654,599

(22) Filed: Jul. 19, 2017

(65) Prior Publication Data

US 2018/0022108 A1 Jan. 25, 2018

(30) Foreign Application Priority Data

Jul. 22, 2016 (JP) ..... 2016-144640

(51) Int. Cl.
*B41J 2/14* (2006.01)
*B41J 2/21* (2006.01)
*B41J 2/205* (2006.01)

(52) U.S. Cl.
CPC ..... *B41J 2/2128* (2013.01); *B41J 2/1404* (2013.01); *B41J 2/14024* (2013.01); *B41J 2/2054* (2013.01); *B41J 2202/06* (2013.01); *B41J 2202/19* (2013.01)

(58) Field of Classification Search
CPC .. B41J 2/14032; B41J 2/1404; B41J 2/14145; B41J 2/15129; B41J 2/2129; B41J 2/14024; B41J 2/2054; B41J 2/155; B41J 2002/14169; B41J 2202/21; B41J 2202/19; B41J 2202/06
See application file for complete search history.

(56) References Cited

U.S. PATENT DOCUMENTS 6,520,624 B1 * 2/2003 Horvath ..... B41J 2/14024 347/13
2004/0085394 A1 * 5/2004 Martin ..... B41J 2/14072 347/42
2015/0328890 A1 * 11/2015 Moriya ..... B41J 2/14145 347/47

FOREIGN PATENT DOCUMENTS

CN 104772986 A 7/2015
CN 105082766 A 11/2015
JP 2008-526553 A 7/2008

* cited by examiner

*Primary Examiner* — Henok D Legesse
(74) *Attorney, Agent, or Firm* — Canon U.S.A., Inc. IP Divison

(57) ABSTRACT

A supporting member includes a first supporting portion disposed on a first and second recording element substrate side, and a second supporting portion disposed on a side opposite to the first and second recording element substrate side with respect to the first supporting portion, the first supporting portion includes a first individual flow path for supplying liquid to a first recording element substrate, and a second individual flow path for supplying liquid to a second recording element substrate, and the second supporting portion includes a common flow path for supplying liquid to the first and second individual flow paths.

19 Claims, 10 Drawing Sheets

LIQUID DISCHARGE HEAD USING DISCHARGE ENERGY GENERATION ELEMENTS

BACKGROUND

Field of the Disclosure

The present disclosure relates to a liquid discharge head for discharging liquid in pressure chambers from discharge ports, using discharge energy generation elements.

Description of the Related Art

In recent years, an inkjet printer is used not only for printing in homes, but also for business purposes such as business and retail photography, or for industrial purposes such as electronic circuit drawing and panel display, and the use of the inkjet printer increasingly expands. A liquid discharge head of an inkjet printer for such business printing is strongly required to perform high-speed printing. To meet this requirement, the width of the liquid discharge head, which discharges liquid such as ink, is made longer than the width of a recording medium, thereby obtaining a line head.

As methods for lengthening the width of the liquid discharge head, a plurality of recording element substrates including discharge ports are arranged in the longitudinal direction of the liquid discharge head in such a manner that parts of the recording element substrates overlap each other. Among these methods, the publication of Japanese Translation of PCT International Application No. 2008-526553 discusses a method for arranging recording element substrates including discharge ports in a line in a longitudinal direction. The recording element substrates are thus arranged in a line, whereby it is possible to reduce the shift width of the recording element substrates in the scanning direction of a print product at the joints between the recording element substrates and reduce the shift width of a discharge port array between the recording element substrates.

Generally, the positional accuracy of a plurality of individual flow paths, which are flow paths formed in a supporting member for supporting recording element substrates, is influenced by the processing accuracy of the individual flow paths. Particularly, there is a tendency that the greater the thickness of the supporting member, the more deteriorating the processing accuracy.

In the configuration of the publication of Japanese Translation of PCT International Application No. 2008-526553, in a plurality of individual flow paths formed in a supporting member, variation occurs in the positional accuracy of the individual flow paths to be formed since the thickness of the supporting member is large. Thus, in a case where an individual flow path is formed at a position closer to an end portion of the supporting member, the positional accuracy is limited. Thus, in each recording element substrate, the distance of a supply path between an individual flow path in the furthest end portion in the longitudinal direction and a discharge port in the furthest end portion in the longitudinal direction becomes long, and the pressure loss of the supply path becomes large. This may cause image unevenness.

SUMMARY

The present disclosure is directed to a liquid discharge head capable of reducing the pressure loss of a supply path and forming a high-grade image.

According to an aspect of the present disclosure, a liquid discharge head includes first and second recording element substrates, each including discharge ports for discharging liquid and energy generation elements for generating energy for use in discharging liquid, and arranged along a longitudinal direction of the liquid discharge head, and a supporting member configured to support the first and second recording element substrates, wherein the supporting member includes a first supporting portion, which is disposed on a first and second recording element substrate side, and a second supporting portion, which is disposed on a side opposite to the first and second recording element substrate side, wherein the first supporting portion includes a first individual flow path for supplying liquid to the first recording element substrate, and a second individual flow path for supplying liquid to the second recording element substrate, and wherein the second supporting portion includes a common flow path for supplying liquid to the first and second individual flow paths.

According to another aspect of the present disclosure, a liquid discharge head includes first and second recording element substrates, each including discharge ports for discharging liquid and energy generation elements for generating energy for use in discharging liquid, and linearly arranged along a longitudinal direction of the liquid discharge head, a supporting member configured to support the first and second recording element substrates, and a first resin film provided between the first recording element substrate and the supporting member, and a second resin film provided between the second recording element substrate and the supporting member, wherein in one end portion of the first resin film, a first through-hole for supplying liquid to the first recording element substrate is provided, wherein in one end portion on a first recording element substrate side of the second resin film, a second through-hole for supplying liquid to the second recording element substrate is provided, and wherein in the supporting member, a common flow path for supplying liquid to the first and second through-holes is provided.

Further features of the present disclosure will become apparent from the following description of exemplary embodiments with reference to the attached drawings.

DESCRIPTION OF THE EMBODIMENTS

With reference to the drawings, a liquid discharge head according to exemplary embodiments of the present disclosure will be described below. The liquid discharge head according to the present disclosure is applicable to apparatuses such as a printer, a copying machine, a facsimile including a communication system, and a word processor including a printer unit, and furthermore applicable to an industrial recording apparatus combined in a complex manner with various processing apparatuses. For example, the liquid discharge head according to the present disclosure can also be used to prepare biochips and print electronic circuits.

Further, the following exemplary embodiments are appropriate specific examples of the present disclosure and therefore have various technically desirable limitations. The present exemplary embodiments, however, are not limited to the exemplary embodiments of the specification and other specific methods so long as the present exemplary embodiments follow the idea of the present disclosure.

Figure 1A:
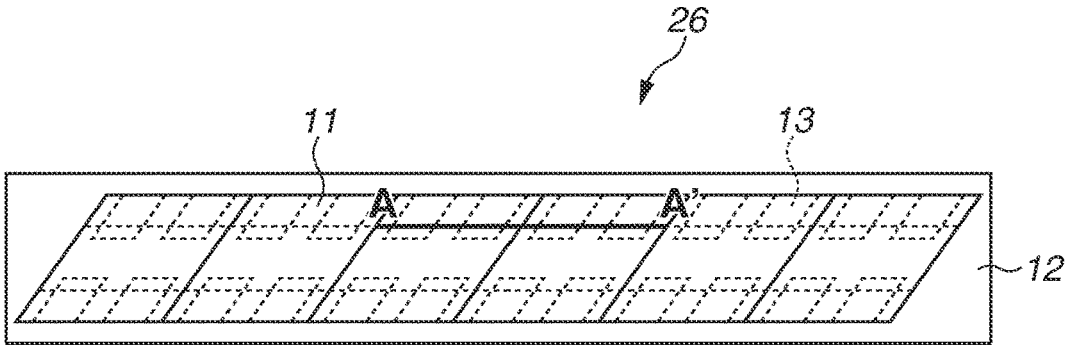
FIGS. 1A to 1C are schematic diagrams illustrating a liquid discharge head as a comparative example to one or more embodiments of the subject disclosure.
Figure 1B:
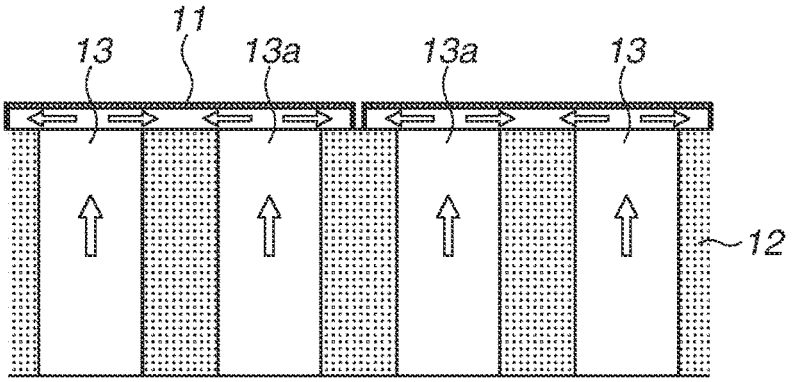
Figure 1C:
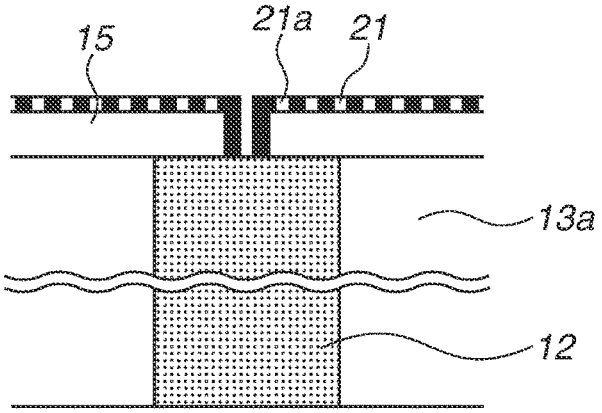
Figure 10A:
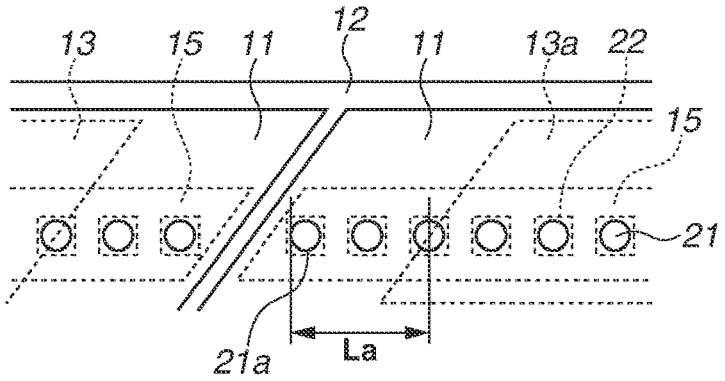
FIG. 10A is an enlarged view of a connection portion between recording element substrates in a cross section taken along A-A' in FIG. 1A.

With reference to FIGS. 1A to 1C and 10A, a liquid discharge head as a comparative example is described before the exemplary embodiments of the present disclosure are described. In FIGS. 1A to 1C, a liquid discharge head 26 includes recording element substrates 11, each of which includes discharge ports 21 for discharging liquid such as ink and a supply path 15 for supplying liquid to the discharge ports 21, and a supporting member 12, which supports the plurality of recording element substrates 11. FIG. 1B illustrates a cross section taken along A-A' in FIG. 1A. FIG. 1C is a partial enlarged view of FIG. 1B. FIG. 10A illustrates a partial enlarged view of FIG. 1A, specifically, an enlarged view of a connection portion between recording element substrates 11 adjacent to each other. For description, members in which the discharge ports 21 are formed are transparently illustrated.

As illustrated in FIG. 1B, in the configuration of this comparative example, the thickness of the supporting member 12 is relatively large. When individual flow paths 13 are formed as through-holes for supplying liquid in the supporting member 12, generally, the greater the thickness of the supporting member 12, the more deteriorating the accuracy (the dimensional accuracy and the positional accuracy) of boring the through-holes. Examples of the method for forming the individual flow paths 13 include injection molding, etching, and laser processing. In any of these methods, however, there is a tendency that the greater the thickness, the more deteriorating the accuracy. As will be described below, in view of the pressure loss of a flow path, it is desirable that among the plurality of individual flow paths 13, an individual flow path 13 on the furthest end portion side of the supporting member 12 should be formed at a position as close to the end portion of the supporting member 12 as possible. If, however, the thickness of the supporting member 12 is large, there are limitations on bringing the individual flow path 13 in the furthest end portion close to the end portion due to processing variation. Thus, as illustrated in FIG. 10A, a distance La between an individual flow path 13*a*, which is formed in the furthest end portion and a discharge port 21*a*, which is located in the furthest end portion among the plurality of discharge ports 21, becomes relatively great. Consequently, the path (La) through which liquid supplied from the individual flow path 13*a* is supplied via the supply path 15 to the discharge port 21*a* in the furthest end portion becomes long, and pressure loss also becomes large. Under the influence of this, the amount of droplets discharged from the discharge ports 21 varies. This influences an image to be recorded, such that density unevenness occurs in the image.

Figure 2A:
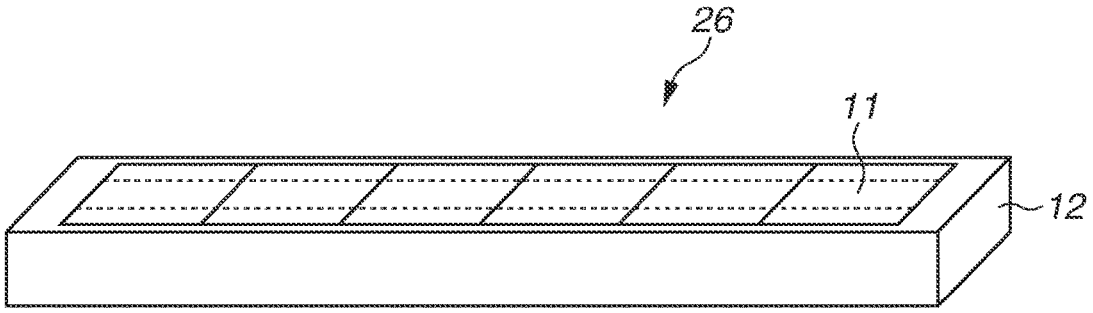
FIGS. 2A and 2B are perspective views of a liquid discharge head according to an exemplary embodiment of the present disclosure.
Figure 2B:
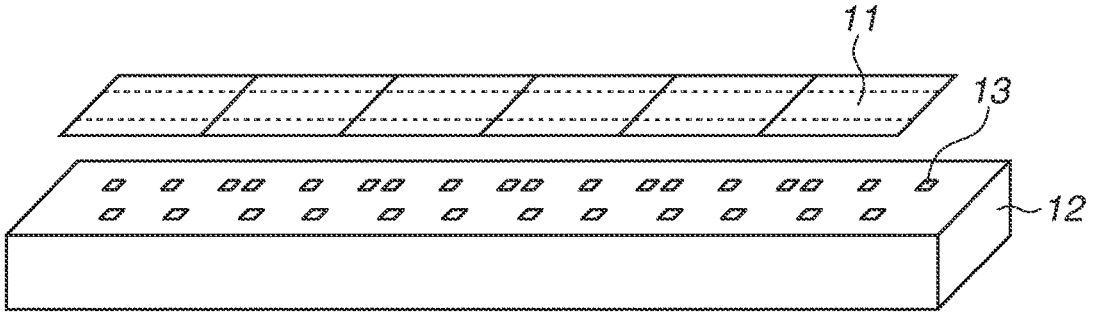
Figure 3A:
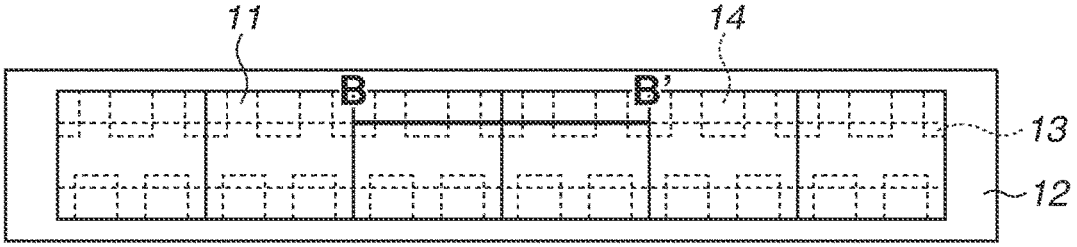
FIGS. 3A to 3C are schematic diagrams illustrating the liquid discharge head according to an exemplary embodiment of the present disclosure.
Figure 3B:
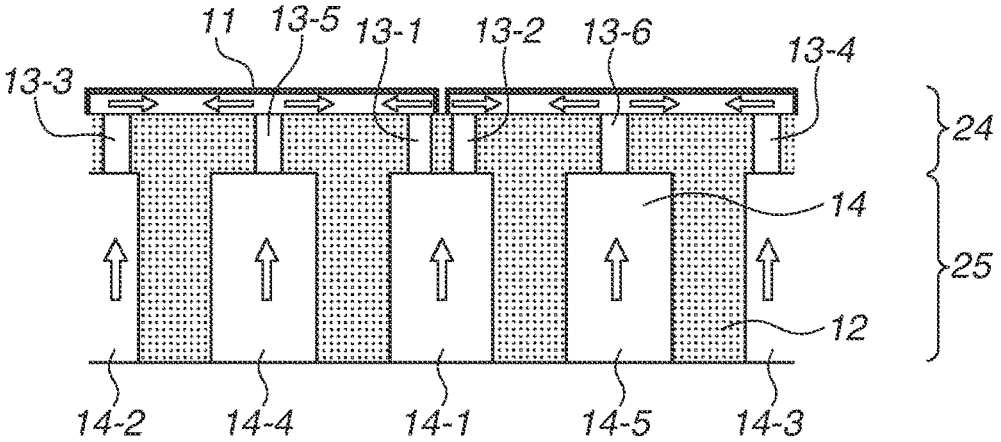
Figure 3C:
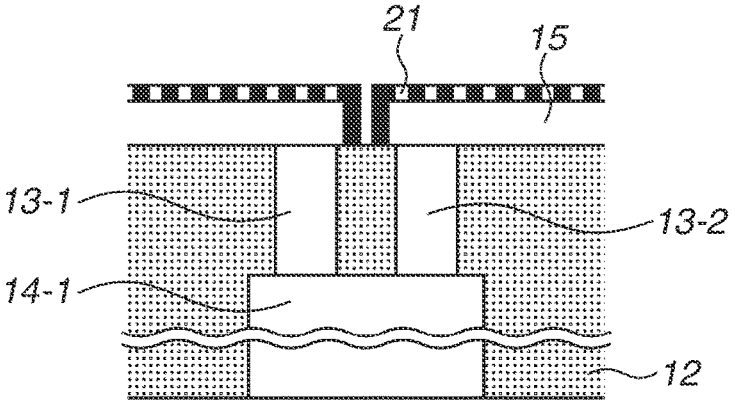
Figure 10B:
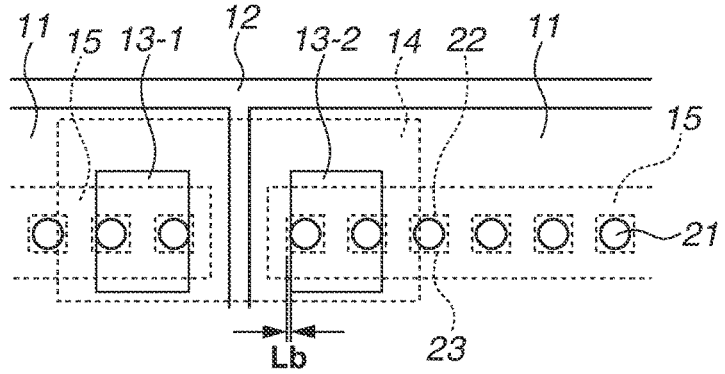
FIG. 10B is an enlarged view of a connection portion between recording element substrates in a cross section taken along B-B' in FIG. 3A.
Figure 10C:
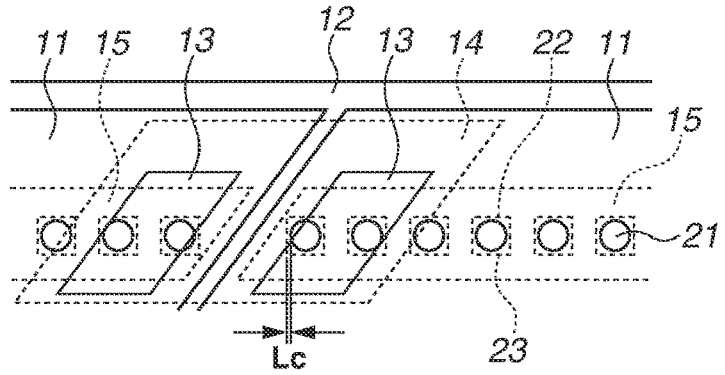
FIG. 10C is an enlarged view of a connection portion between recording element substrates in a cross section taken along C-C' in FIG. 5A.
Figure 10D:
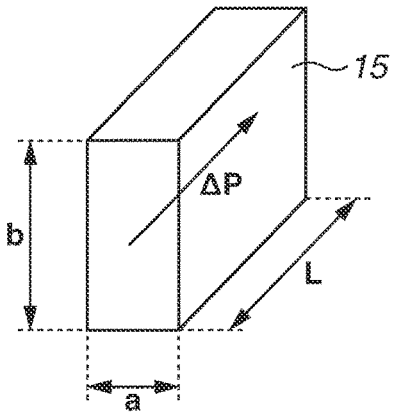
FIG. 10D is a schematic diagram illustrating each supply path in FIGS. 10A to 10C.

In response to the problem in the above comparative example, a first exemplary embodiment is described below. FIGS. 2A, 2B, 3A, 3B, 3C, 10B, and 10D are diagrams illustrating the first exemplary embodiment of the present disclosure. FIG. 2A is a perspective view of a liquid discharge head according to the first exemplary embodiment of the present disclosure. FIG. 2B is an exploded perspective view of the liquid discharge head according to the first exemplary embodiment of the present disclosure. FIG. 3A is a top view of the liquid discharge head according to the first exemplary embodiment of the present disclosure. For ease of description, parts of members are transparently illustrated. FIG. 3B is a cross-sectional view along a cross section B-B' in FIG. 3A. FIG. 3C is an enlarged view of a connection portion between recording element substrates 11 adjacent to each other in FIG. 3B. FIG. 10B is an enlarged view of the connection portion between the recording element substrates 11 along the cross section B-B' in FIG. 3A. FIG. 10D is a schematic diagram of each supply path 15 in FIG. 10B.

As illustrated in FIGS. 2A, 2B, 3A, 3B, and 3C, a liquid discharge head 26 according to the first exemplary embodiment of the present disclosure includes a plurality of recording element substrates 11, which are arranged along the longitudinal direction of the liquid discharge head 26, and a supporting member 12. In each of the recording element substrates 11, energy generation elements 22 (FIG. 10B), which generate energy for use in discharging liquid such as ink, are formed. Discharge ports 21, which discharge liquid, and pressure chambers 23 (FIG. 10B), which are filled with liquid to be discharged from the discharge ports 21, are formed corresponding to the respective energy generation elements 22. In a first supporting portion 24 of the supporting member 12, a plurality of individual flow paths 13 (13-1 to 13-6), which supply liquid to the recording element substrates 11, are provided along the longitudinal direction of the liquid discharge head 26. Further, in a second supporting portion 25 of the supporting member 12, a plurality of common flow paths 14 (14-1 to 14-5), which supply liquid to the individual flow paths 13, are formed along the longitudinal direction of the liquid discharge head 26. The flow path width (diameter) of each individual flow path 13 is smaller than the flow path width (diameter) of each common flow path 14. As illustrated in FIG. 3B, a first individual flow path 13-1 and a second individual flow path 13-2 communicate with a first common flow path 14-1. Further, a third individual flow path 13-3 communicates with a second common flow path 14-2. A fourth individual flow path 13-4, which is located in the other end portion of one of the recording element substrates 11, communicates with a third common flow path 14-3. A fifth individual flow path 13-5 communicates with a fourth common flow path 14-4. A sixth individual flow path 13-6 communicates with a fifth common flow path 14-5.

The supporting member 12 includes two regions, namely the first supporting portion 24 on the side where the plurality of individual flow paths 13 are formed (the downstream side), and the second supporting portion 25 on the opposite side (the upstream side) of the recording element substrates 11 with respect to the first supporting portion 24. In the present exemplary embodiment, the supporting member 12 is configured as an integrated member including the first supporting portion 24 and the second supporting portion 25. Flow paths provided in the supporting member 12 are thus separated into the upstream side and the downstream side, whereby it is possible to make the length of the supply path of each individual flow path provided in a first supporting portion on the downstream side shorter than that in the above comparative example. This can improve the processing accuracy when individual supply paths are formed.

Further, the plurality of recording element substrates 11 are placed to be arranged on the supporting member 12. In this case, the recording element substrates are arranged in such a manner that recording element substrates 11 adjacent to each other are placed in a line (linearly) in the longitudinal direction of the liquid discharge head 26 by partially overlapping each other in the longitudinal direction. The recording element substrates 11 do not need to be arranged exactly in a line in the longitudinal direction, and may be arranged while shifted to some extent.

In FIGS. 3A to 3C, on back surfaces (the surfaces on the supporting member 12 side) of the recording element substrates 11, supply paths 15, to which liquid is supplied from the plurality of individual flow paths 13 of the supporting member 12, are formed. Further, the liquid discharge head 26 according to the present exemplary embodiment includes a common flow path 14 (14-1) disposed over end portions of recording element substrates 11 placed adjacent to each other on the supporting member 12, as viewed in the direction in which liquid is discharged from the discharge ports 21. There is some leeway in the positional accuracy of the flow paths 14 in the second supporting portion 25, relative to that of the individual flow paths 13. Thus, it is possible to make the width of the flow path of each common flow path 14 relatively large and place the common flow path 14 over a connection portion between recording element substrates 11. Consequently, it is possible to secure the flow path of the connection portion in the region of the second supporting portion 25 and form individual flow paths having high accuracy in the region of the first supporting portion 24 on the downstream side. In the present exemplary embodiment, the distance of each individual flow path 13 in the thickness direction of the supporting member 12 is formed to be shorter than the distance of each common flow path 14 in the thickness direction of the supporting member 12, whereby it is possible to perform processing with higher accuracy. Thus, it is possible to make the spaces between the individual flow paths 13 smaller than the spaces between the common flow paths 14.

At this time, as illustrated in FIG. 3B, liquid passes through the common flow paths 14, the individual flow paths 13, and the supply paths 15 in this order and is supplied to each of the pressure chambers 23 and the energy generation elements 22. In FIG. 10B, a plurality of discharge ports 21 are formed in the longitudinal direction of each recording element substrate 11, thereby forming a discharge port array. Further, a supply path 15 is formed on the back surface of the recording element substrate 11 along the discharge port array. In the present exemplary embodiment illustrated in FIG. 10B, in the supporting member 12, individual flow paths 13, which supply liquid to the supply path 15, and common flow paths 14, which supply liquid to the individual flow paths 13, are formed. Thus, it is possible to improve the positional accuracy and the processing accuracy of the individual flow paths 13. Thus, it is possible to make a distance Lb of the supply path 15 between an individual flow path 13 in one end portion in the longitudinal direction of the recording element substrate 11 and a discharge port 21 in the one end portion in the longitudinal direction, shorter than the configuration of the comparative example in FIG. 10A. In FIG. 10B, the distance Lb is illustrated as Lb≃0. At this time, pressure loss ΔP (FIG. 10D) of the supply path 15 can be obtained by formula (1).

$$\Delta P = Q \times R \text{[mmAq]} \qquad \text{formula (1)}$$

In formula (1) and FIG. 10D, ΔP represents the pressure loss of the supply path 15 in the farthest end portion in the longitudinal direction of the recording element substrate 11. Q represents the discharge flow rate of the supply path 15. R represents the flow path resistance of the supply path 15. L represents the length of the supply path 15 between the individual flow path 13 in the furthest end portion in the longitudinal direction of the recording element substrate 11 and the discharge port 21 in the furthest end portion in the longitudinal direction. Further, a represents the width of the supply path 15, and b represents the height of the supply path 15. At this time, for example, it is assumed that the nozzle density is 1200 dpi, the discharge frequency is 10 kHz, the amount of liquid to be discharged is 5 pl, the viscosity of liquid is 4 cp, a is 100 μm, b is 300 μm, La in the comparative example in FIG. 10A is 500 μm, and Lb in the present exemplary embodiment is 200 μm. In this case, ΔP in the comparative example is about 5.8 mmAq. On the other hand, ΔP in the first exemplary embodiment of the present disclosure is about 0.9 mmAq. Thus, the first exemplary embodiment is employed, whereby it is possible to reduce the pressure loss ΔP of the supply path 15 in the furthest end portion in the longitudinal direction of the recording element substrate 11 by about 84.5%.

In the supporting member 12, common flow paths 14 are formed over end portions of recording element substrates 11 placed adjacent to each other on the supporting member 12. Consequently, in each recording element substrate 11, it is possible to shorten the distance of the supply path 15 between the individual flow path 13 in the furthest end portion in the longitudinal direction of the recording element substrate 11 and the discharge port 21 in the furthest, end portion in the longitudinal direction. This can reduce the pressure loss of the supply path 15 and form a high-grade image at the joint between the recording element substrates 11 adjacent to each other. Further, the present disclosure can be particularly suitably applied to a line-type liquid discharge head, in which the length in the longitudinal direction of the supporting member 12 is equal to or greater than the width of a recording medium to which droplets from the discharge ports 21 are applied. That is it is possible to arrange the recording element substrates 11 across a width equal to or greater than a page width in the state where a high-grade image is formed at the joint between recording element substrates 11 adjacent to each other. Thus, it is possible to form a high-grade image across a page width.

As a material forming the supporting member 12, various materials are applicable. As an example, it is desirable that the supporting member 12 should be formed of resin or alumina. In a case where the supporting member 12 is formed of resin, there is a method for processing the individual flow paths 13 and the common flow paths 14 by injection molding, for example. Further, in a case where the supporting member 12 is formed of alumina, the individual flow paths 13 and the common flow paths 14 may be produced by, for example, laminating a plurality of alumina members each having a small thickness in the thickness direction of the supporting member 12.

Figure 4A:
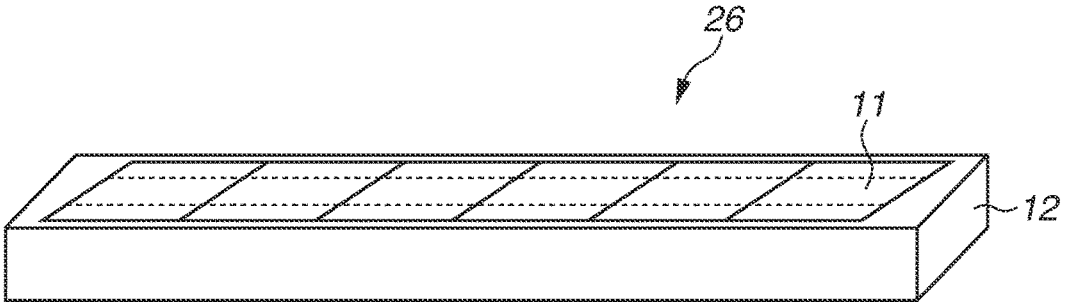
FIGS. 4A and 4B are perspective views of a liquid discharge head according to an exemplary embodiment of the present disclosure.
Figure 4B:
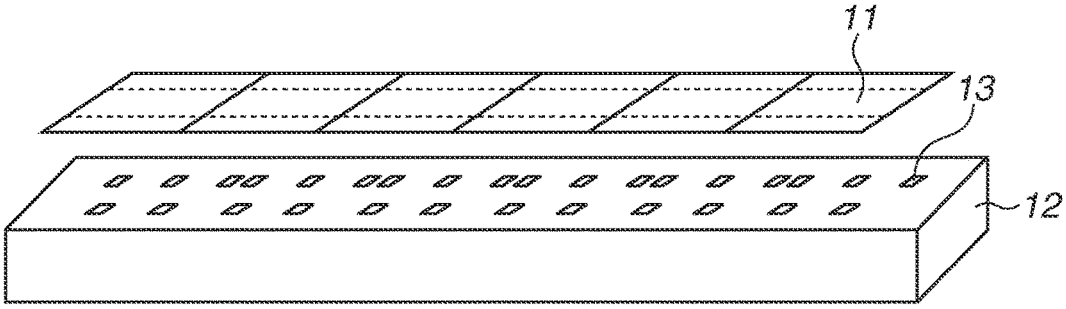
Figure 5A:
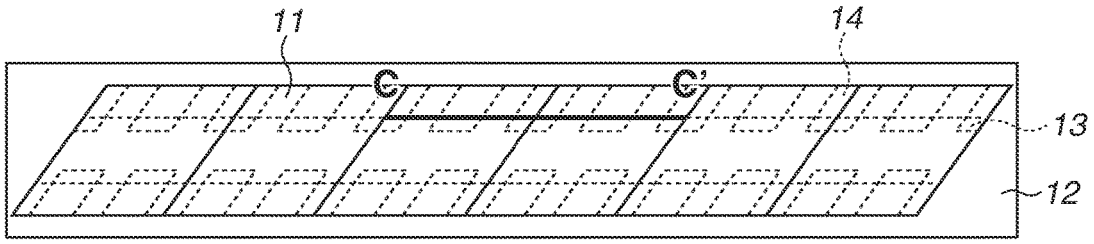
FIGS. 5A to 5C are schematic diagrams illustrating the liquid discharge head according to an exemplary embodiment of the present disclosure.
Figure 5B:
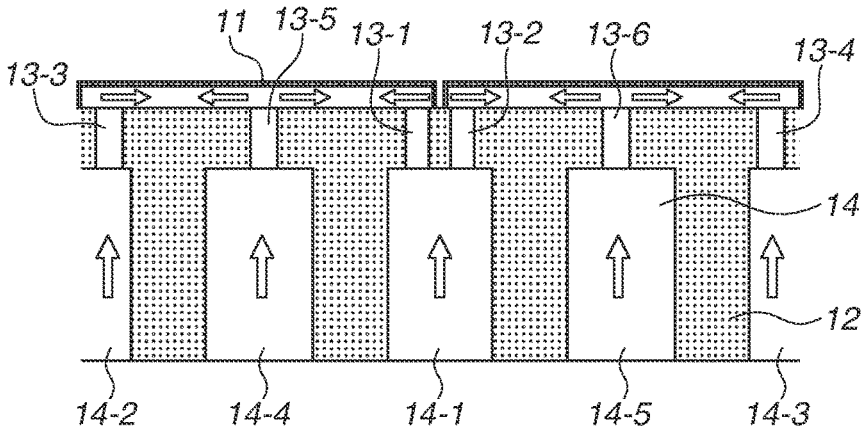
Figure 5C:
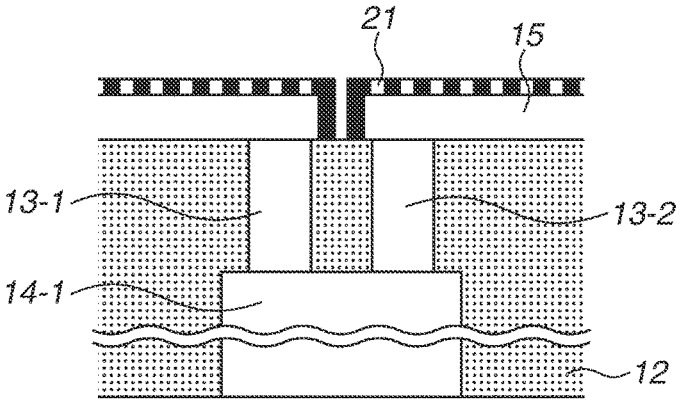

A second exemplary embodiment is described below. FIGS. 4A, 4B, 5A, 5B, 5C, 10C, and 10D are diagrams illustrating the second exemplary embodiment of the present disclosure. FIG. 4A is a perspective view of a liquid discharge head according to the second exemplary embodiment of the present disclosure. FIG. 4B is an exploded perspective view of the liquid discharge head according to the second exemplary embodiment of the present disclosure. FIG. 5A is a top view of the liquid discharge head according to the second exemplary embodiment of the present disclosure. FIG. 5B is a cross-sectional view along a cross section C-C' in FIG. 5A. FIG. 5C is an enlarged view of a connection portion between recording element substrates in FIG. 5B. FIG. 10C is an enlarged view of the connection portion between the recording element substrates along the cross section C-C' in FIG. 5A. FIG. 10D is a schematic diagram of each supply path in FIG. 10B. The differences from the first exemplary embodiment are mainly described, and a configuration similar to that in the first exemplary embodiment is not described below.

A liquid discharge head 26 according to the second exemplary embodiment of the present disclosure is mainly different from that according to the first exemplary embodiment in that, as illustrated in FIG. 5A, the outer shape of each recording element substrate is an approximately parallelogram shape. With such a configuration, it is possible to linearly and continuously place a plurality of recording element substrates 11. Thus, the present exemplary embodiment can be particularly suitably applied when a line-type liquid discharge head is downsized. Also in the configuration of the present, exemplary embodiment, as illustrated in FIG. 10C, it is possible to shorten a distance Lc of a supply path 15 between an individual flow path 13 in the furthest end portion in the longitudinal direction of each recording element substrate 11 and a discharge port 21 in the furthest end portion in the longitudinal direction. In FIG. 10C, the distance Lc is illustrated as $Lc \simeq 0$.

Further, as illustrated in FIGS. 4A, 4B, 5A, 5B, and 5C, the plurality of parallelogram-shaped recording element substrates 11 are placed in the longitudinal direction of the liquid discharge head 26 such that recording element substrates 11 adjacent to each other partially overlap each other in both the longitudinal direction of the liquid discharge head 26 and a scanning direction. This can reduce the space between the recording element substrates 11 adjacent to each other. Thus, it is possible to reduce the shift width of a discharge port array at the joint between the recording element substrates 11. As a result, it is possible to reduce a failure such as image unevenness and further form a high-grade image at the joint between the recording element substrates 11.

Figure 6A:
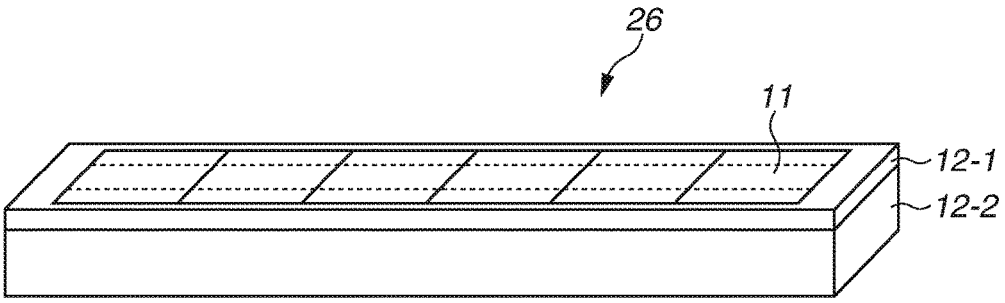
FIGS. 6A and 6B are perspective views of a liquid discharge head according to an exemplary embodiment of the present disclosure.
Figure 6B:
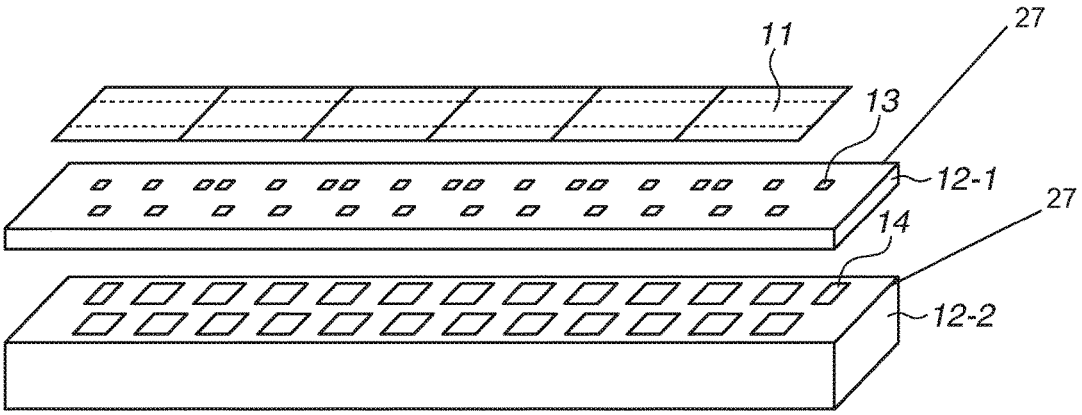
Figure 7A:
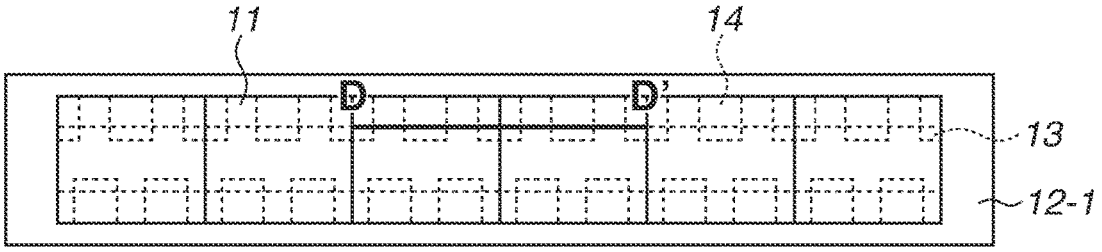
FIGS. 7A to 7C are schematic diagrams illustrating the liquid discharge head according to an exemplary embodiment of the present disclosure.
Figure 7B:
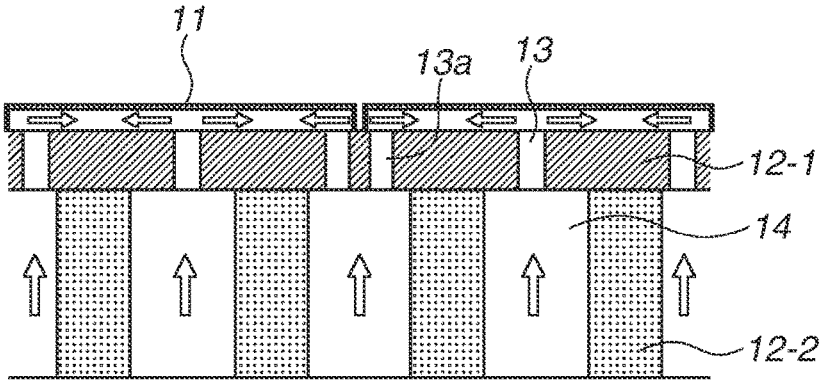
Figure 7C:
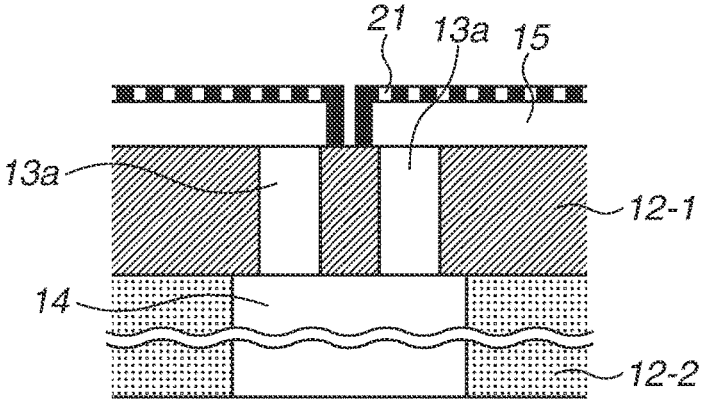

A third exemplary embodiment is described below. FIGS. 6A, 6B, 7A, 7B, and 7C are diagrams illustrating the third exemplary embodiment of the present disclosure. FIG. 6A is a perspective view of a liquid discharge head according to the third exemplary embodiment of the present disclosure. FIG. 6B is an exploded perspective view of the liquid discharge head according to the third exemplary embodiment of the present disclosure. FIG. 7A is a top view of the liquid discharge head according to the third exemplary embodiment of the present disclosure. FIG. 7B is a cross-sectional view along a cross section D-D' in FIG. 7A. FIG. 7C is an enlarged view of a connection portion between recording element substrates in FIG. 7B. The differences from the above exemplary embodiments are mainly described, and a configuration similar to those in the above exemplary embodiments are not described below.

As illustrated in FIGS. 6A, 6B, 7A, 7B, and 7C, a liquid discharge head 26 according to the third exemplary embodiment of the present disclosure includes recording element substrates 11, a first supporting member 12-1, and a second supporting member 12-2. That is, the configuration is such that separate members, namely the first supporting member 12-1 and the second supporting member 12-2, are laminated. As illustrated in FIG. 7B, in the first supporting member 12-1, a plurality of individual flow paths 13 are provided. In the second supporting member 12-2, a plurality of common flow paths 14 are provided. The supporting member is thus composed of two different laminated members, whereby it is possible to reduce the flow path length of each individual flow path 13 similarly to the above exemplary embodiments. Thus, it is possible to improve the processing accuracy and the positional accuracy of the individual flow paths 13. In the present exemplary embodiment, the configuration is such that two members are laminated. The present exemplary embodiment, however, is not limited thereto. Alternatively, a laminated body including three or more members (a configuration in which three or more layers are laminated) may be used.

As illustrated in FIGS. 6A, 6B, 7A, 7B, and 7C, in the first supporting member 12-1, the plurality of individual flow paths 13, which supply liquid to the recording element substrates 11, are formed. In the second supporting member 12-2, the plurality of common flow paths 14, which supply liquid to the individual flow paths 13, are formed. Consequently, it is only necessary to perform a single type of processing on each member, and this facilitates processing. Thus, it is possible to enhance the processing accuracy.

Further, based on the present exemplary embodiment, the first and second supporting members can also be formed of different materials. For example, as an example of a material forming the second supporting member 12-2, it is desirable that the second supporting member 12-2 should be formed of resin or alumina. In a case where the second supporting member 12-2 is formed of resin, there is a method for processing the individual flow paths 13 and the common flow paths 14 by injection molding, for example. Further, in a case where the second supporting member 12-2 is formed of alumina, there is a method for, for example, laminating a plurality of alumina members each having a small thickness in the thickness direction of the supporting member 12-2, thereby producing the individual flow paths 13 and the common flow paths 14. Further, it is desirable that the thickness of the first supporting member 12-1 should be smaller in terms of improvement in the processing accuracy. Further, as an example of a material forming the first supporting member 12-1, it is desirable that the first supporting member 12-1 should be formed of a silicon substrate or a resin film 27. A silicon substrate is joined to, or a resin film 27 is laminated on, the recording element substrates 11 in a wafer form, whereby it is possible to join the first supporting member 12-1 to the recording element substrates 11. Thus, it is possible to reduce the number of processes as compared with the case where the first supporting member 12-1 is joined to each recording element substrate 11. Further, since the individual flow paths 13 are formed in a semiconductor process, it is possible to achieve higher processing accuracy and positional accuracy. In the present exemplary embodiment, the first supporting member 12-1 is a single common member. Alternatively, the configuration may be such that a plurality of first supporting members 12-1 are obtained by dividing the first supporting member 12-1 for each recording element substrate 11. Consequently, the present exemplary embodiment can be carried out more suitably in the semiconductor process.

Figure 8A:
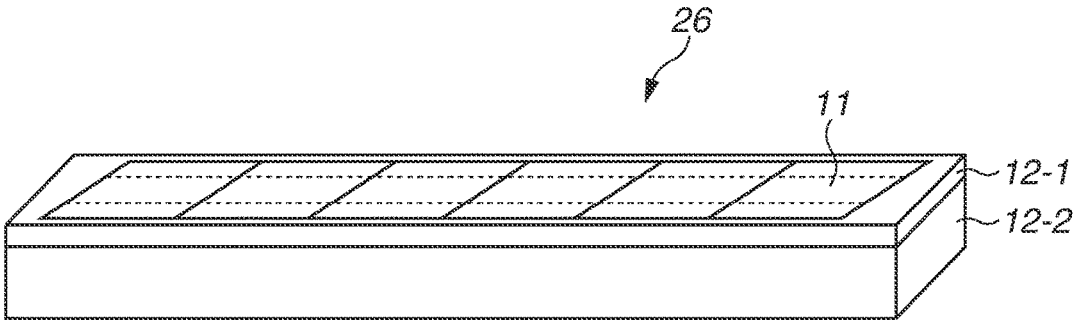
FIGS. 8A and 8B are perspective views of a liquid discharge head according to an exemplary embodiment of the present disclosure.
Figure 8B:
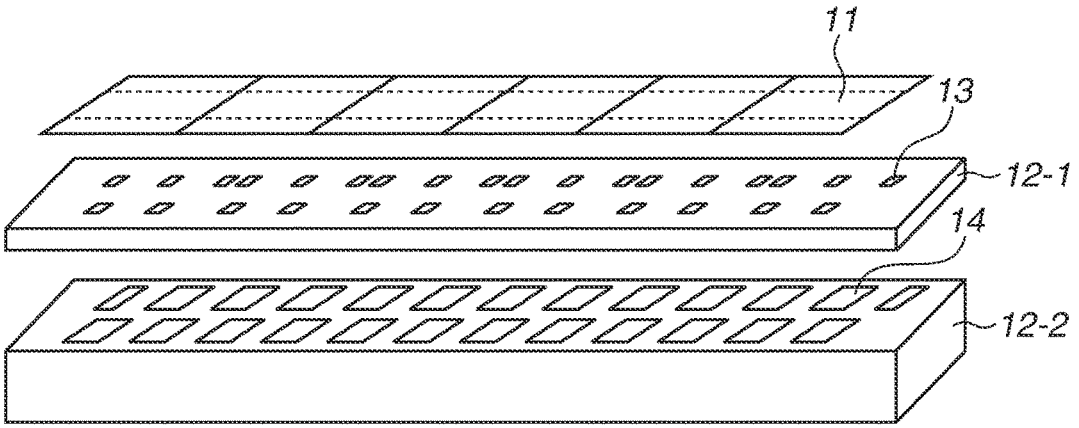
Figure 9A:
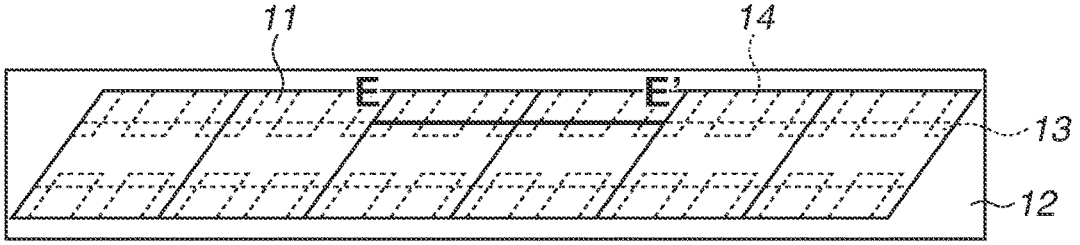
FIGS. 9A to 9C are schematic diagrams illustrating the liquid discharge head according to an exemplary embodiment of the present disclosure.
Figure 9B:
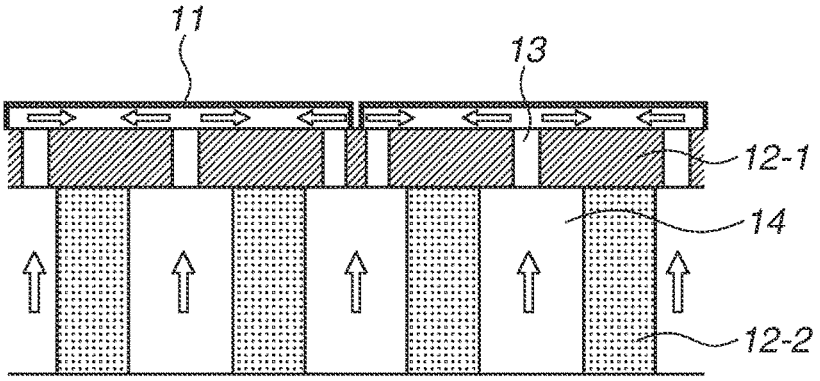
Figure 9C:
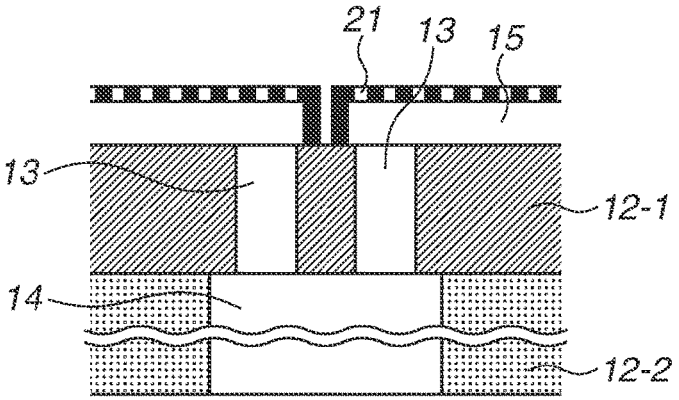

A fourth exemplary embodiment is described below. FIGS. 8A, 8B, 9A, 9B, and 9C are diagrams illustrating the fourth exemplary embodiment of the present disclosure. FIG. 8A is a perspective view of a liquid discharge head according to the fourth exemplary embodiment of the present disclosure. FIG. 8B is an exploded perspective view of the liquid discharge head according to the fourth exemplary embodiment of the present disclosure. FIG. 9A is a top view of the liquid discharge head according to the fourth exemplary embodiment of the present disclosure. FIG. 9B is a cross-sectional view along a cross section E-E' in FIG. 9A. FIG. 9C is an enlarged view of a connection portion between recording element substrates in FIG. 9B. The differences from the above exemplary embodiments are mainly described, and a configuration similar to those in the above exemplary embodiments is not described below.

A liquid discharge head 26 according to the fourth exemplary embodiment of the present disclosure has a configuration obtained by combining the second and third exemplary embodiments. Specifically, as illustrated in FIGS. 8A, 8B, 9A, 9B, and 9C, the outer shape of each recording element substrate 11 is an approximately parallelogram shape, and a supporting member 12 has a configuration in which a first supporting member 12-1 and a second supporting member 12-2 are laminated. In the present exemplary embodiment, approximately parallelogram recording element substrates 11 are linearly placed, whereby it is possible to provide a small-sized line-type head. Further, the configuration is such that a plurality of supporting members is included, whereby it is possible to provide a supporting member having high accuracy, particularly a first supporting member.

Other Exemplary Embodiments

In the above exemplary embodiments, descriptions have been given of the configuration in which the common flow paths 14 supply liquid to the recording element substrates 11. The configuration, however, is not limited thereto. Alternatively, the present disclosure is also applicable to a liquid discharge head including a circulation supply path. In this case, the configuration is such that the common flow paths 14 include common flow paths for supplying liquid to the recording element substrates 11 and common flow paths for collecting liquid from the recording element substrates 11, and the individual flow paths 13 also include both flow paths for supplying liquid and flow paths for collecting liquid. Consequently, it is possible to provide a liquid discharge head including circulation flow paths for supplying liquid to the pressure chambers 23, which include energy generation elements therewithin, and collecting, from the pressure chambers 23, liquid that has not been discharged. That is, the configuration is such that liquid in the pressure chambers 23 is circulated between inside and outside the pressure chambers 23. In a line-type liquid discharge head thus including flow paths for supplying and collecting liquid, the configurations of the flow paths become complicated, and generally, the liquid discharge head becomes large. However, the present disclosure is applied, whereby it is possible to prevent the liquid discharge head from becoming large, while stably supplying liquid. Thus, it is particularly desirable to apply the present disclosure.

Further, the present disclosure only needs to be a liquid discharge head including a technical idea described in the above exemplary embodiments. For example, as an example of a variation, the configuration may be such that a plurality of resin films is provided corresponding to recording element substrates 11, the plurality of recording element substrates 11, which have these resin films on their back surfaces, are supported by individual supporting members, and the resin films, the recording element substrates 11, and the individual supporting members are supported by a common supporting member. In this case, individual flow paths provided in the resin films correspond to the individual flow paths 13 in the second exemplary embodiment, and common flow paths provided in the individual supporting members correspond to the common flow paths 14 in the second exemplary embodiment, whereby it is possible to apply the effects of the present disclosure similarly to the second exemplary embodiment. In the present variation, the configuration is such that a common supporting member is included in addition to the above configuration. In the present variation, the first individual supporting members are formed of thin resin film members, the individual supporting members are formed of members having high stiffness, such as alumina, and the longitudinal common supporting member for commonly supporting the resin films, the recording element substrates 11, and the individual supporting members is formed of a resin mold member.

According to the present disclosure, in each recording element substrate, the distance of a supply path between an individual flow path in an end portion in the longitudinal direction of a supporting member and a discharge port in the end portion in the longitudinal direction is shortened, whereby it is possible to reduce the pressure loss of the supply path. As a result, it is possible to reduce a failure such as image unevenness and form a high-grade image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-144640, filed Jul. 22, 2016, which is hereby incorporated by reference herein in its entirety.

What is claimed is:

1. A liquid discharge head comprising:

first and second recording element substrates, each including discharge ports for discharging liquid and energy generation elements for generating energy for use in discharging liquid, and arranged along a longitudinal direction of the liquid discharge head; and a supporting member configured to support the first and second recording element substrates, wherein the supporting member includes a first supporting portion, which is a portion on a side, in a thickness direction of the supporting member, where the first and second recording element substrates are provided, and a second supporting portion, which is a portion on an opposite side of the first supporting portion, wherein the first supporting portion includes a first individual flow path for supplying liquid to the first recording element substrate, and a second individual flow path for supplying liquid to the second recording element substrate, wherein the second supporting portion includes a common flow path for supplying liquid to the first and second individual flow paths, wherein the first supporting portion includes a third individual flow path for supplying liquid to the first recording element substrate, and a fourth individual flow path for supplying liquid to the second recording element substrate.

2. The liquid discharge head according to claim 1, wherein a thickness of the first supporting portion is smaller than a thickness of the second supporting portion.

3. The liquid discharge head according to claim 1, wherein the first and second recording element substrates are linearly disposed along the longitudinal direction, the first individual flow path communicates with one end portion of the first recording element substrate, and the second individual flow path communicates with one end portion of the second recording element substrate which is on the side of the one end portion of the first recording element substrate.

4. The liquid discharge head according to claim 1, wherein the common flow path is disposed over one end portion of the first recording element substrate and one end portion of the second recording element substrate, as viewed in a direction in which liquid is discharged from the discharge ports.

5. The liquid discharge head according to claim 1, wherein the third individual flow path is disposed in the other end portion opposite to one end portion of the first recording element substrate, and the fourth individual flow path is disposed in the other end portion opposite to one end portion of the second recording element substrate.

6. The liquid discharge head according to claim 1, wherein the second supporting portion includes a second common flow path for supplying liquid to the third individual flow path.

7. The liquid discharge head according to claim 1, wherein the second supporting portion includes a third common flow path for supplying liquid to the fourth individual flow path.

8. The liquid discharge head according to claim 1, wherein the first supporting portion includes a fifth individual flow path for supplying liquid to the first recording element substrate, and a sixth individual flow path for supplying liquid to the second recording element substrate, the fifth individual flow path is disposed between the first and third individual flow paths, and the sixth individual flow path is disposed between the second and fourth individual flow paths.

9. The liquid discharge head according to claim 8, wherein the second supporting portion includes a fourth common flow path for supplying liquid to the fifth individual flow path, and a fifth common flow path for supplying liquid to the sixth individual flow path.

10. The liquid discharge head according to claim 1, wherein the supporting member including the first and second supporting portions is formed of an integrated member.

11. The liquid discharge head according to claim 1, wherein the supporting member includes a first supporting member including the first supporting portion, and a second supporting member including the second supporting portion.

12. The liquid discharge head according to claim 11, wherein a thickness of the first supporting member is smaller than a thickness of the second supporting member.

13. The liquid discharge head according to claim 11, wherein the supporting member is a laminated body having three or more layers including the first and second supporting members.

14. The liquid discharge head according to claim 1, wherein a length in the longitudinal direction of the liquid discharge head is longer than a length in the longitudinal direction of a recording medium to which liquid discharged from the discharge ports is applied.

15. The liquid discharge head according to claim 1, wherein in the supporting member, three or more recording element substrates including the first and second recording element substrates are linearly disposed along the longitudinal direction.

16. The liquid discharge head according to claim 1, further comprising pressure chambers including the energy generation elements therewithin, wherein liquid in the pressure chambers is circulated between inside and outside the pressure chambers.

17. A liquid discharge head comprising:

first and second recording element substrates, each including discharge ports for discharging liquid and energy generation elements for generating energy for use in discharging liquid, and linearly arranged along a longitudinal direction of the liquid discharge head;

a supporting member configured to support the first and second recording element substrates; and a first resin film provided between the first recording element substrate and the supporting member, and a second resin film provided between the second recording element substrate and the supporting member, wherein in one end portion of the first resin film, a first through-hole for supplying liquid to the first recording element substrate is provided, wherein in one end portion on a first recording element substrate side of the second resin film, a second through-hole for supplying liquid to the second recording element substrate is provided, wherein in the supporting member, a common flow path for supplying liquid to the first and second through-holes is provided, wherein in the first resin film, a plurality of through-holes including the first through-hole are arranged along the longitudinal direction, and wherein in the second resin film, a plurality of through-holes including the second through-hole are arranged along the longitudinal direction.

18. The liquid discharge head according to claim 17, wherein the common flow path is disposed over one end portion of the first recording element substrate and one end portion of the second recording element substrate, as viewed in a direction in which liquid is discharged from the discharge ports.

19. The liquid discharge head according to claim 17, further comprising pressure chambers including the energy generation elements therewithin, wherein liquid in the pressure chambers is circulated between inside and outside the pressure chambers.

* * * * *